US011614279B2

(12) United States Patent
Jafa et al.

(10) Patent No.: US 11,614,279 B2
(45) Date of Patent: Mar. 28, 2023

(54) BEVERAGE COOLER

(71) Applicant: PepsiCo, Inc., Purchase, NY (US)

(72) Inventors: Emad Jafa, Brewster, NY (US); Eleonor Dorin Stoenescu, Stamford, CT (US); Thomas Henry Hellier, Cambridge (GB); James Simon Oliver, Cambridgeshire (GB)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/054,596

(22) Filed: Aug. 3, 2018

(65) Prior Publication Data

US 2020/0018542 A1 Jan. 16, 2020

Related U.S. Application Data

(60) Provisional application No. 62/697,276, filed on Jul. 12, 2018.

(51) Int. Cl.
*F25D 31/00* (2006.01)
*F25D 11/00* (2006.01)
(Continued)

(52) U.S. Cl.
CPC ..... *F25D 31/007* (2013.01); *F25D 11/00* (2013.01); *F25D 17/067* (2013.01);
(Continued)

(58) Field of Classification Search
CPC .... F25D 31/007; F25D 17/067; F25D 25/005; F25D 11/00; F25D 27/00;
(Continued)

(56) References Cited

U.S. PATENT DOCUMENTS 1,383,453 A * 7/1921 Dougan ..... B65D 51/26 217/129
1,652,600 A * 12/1927 Beers ..... F25D 31/007 15/210.1
(Continued)

FOREIGN PATENT DOCUMENTS

WO 00/21830 A1 4/2000
WO WO-2008069667 A2 * 6/2008 ..... F25D 17/045
(Continued)

OTHER PUBLICATIONS

VINOTEMP, "2-Bottle Thermoelectric Open Wine Cooler", vinotemp.com, retrieved Jun. 28, 2017, 5 pages, <URL: https://www.vinotemp.com/element/wine-coolers/il-romanzo/2-bottle-thermoelectric-open-wine-cooler>.
(Continued)

*Primary Examiner* — Eric S Ruppert
*Assistant Examiner* — Kirstin U Oswald
(74) *Attorney, Agent, or Firm* — Sterne, Kessler, Goldstein & Fox P.L.L.C.

(57) ABSTRACT

Beverage coolers for storing and cooling bottled beverages. A beverage cooler may include a cooling chamber cooled by a refrigeration system, and openings in the cooling chamber for receiving bottled beverages to be chilled. The openings may have doors and/or seals to minimize heat exchange between the cooling chamber and the environment with or without bottles disposed in the openings. Each of the openings may have a visual indicator, such as a plurality of LEDs, configured to indicate the temperature of the bottle disposed in the opening.

21 Claims, 7 Drawing Sheets

(51) Int. Cl.
*F25D 17/06* (2006.01)
*F25D 25/00* (2006.01)
*F25D 27/00* (2006.01)
*F25D 23/02* (2006.01)

(52) U.S. Cl.
CPC ..... *F25D 25/005* (2013.01); *F25D 27/00* (2013.01); *F25D 23/02* (2013.01); *F25D 2331/803* (2013.01)

(58) Field of Classification Search
CPC ..... F25D 2331/803; F25D 23/02; F25D 2400/10; F25D 27/005; F25D 2331/805; F25D 2700/16
USPC ..... 62/407
See application file for complete search history.

(56) References Cited

U.S. PATENT DOCUMENTS 1,865,349 A * 6/1932 Wright ..... F25B 35/04 62/480
1,979,323 A * 11/1934 Felesina ..... F25D 3/06 141/330
2,010,927 A * 8/1935 Paulus ..... F25D 25/02 312/351
2,024,648 A * 12/1935 Kissing et al. ..... F25D 3/14 62/388
2,029,263 A * 1/1936 Keighley ..... F25D 11/02 211/74
2,061,427 A * 11/1936 King ..... F25D 17/02 62/437
2,200,502 A * 5/1940 Johnson ..... F25D 17/062 165/181
2,204,804 A * 6/1940 Heintzen ..... F25D 31/007 62/449
2,226,395 A * 12/1940 Tanner ..... F25D 17/062 62/418
2,230,862 A * 2/1941 Carroll ..... F25D 31/007 62/431
2,241,023 A * 5/1941 Tanner ..... F25D 19/02 62/450
2,245,234 A * 6/1941 Tanner ..... F25D 19/02 62/450
2,250,557 A * 7/1941 Tull ..... F25D 17/06 62/380
2,275,323 A * 3/1942 Schweller ..... F25D 17/062 62/418
2,327,649 A * 8/1943 Keighley ..... F25D 31/007 62/418
2,401,613 A * 6/1946 Charland ..... F25D 11/025 62/331
2,417,123 A * 3/1947 Philipp ..... F25D 25/02 211/74
2,422,350 A * 6/1947 Gross ..... F25D 31/007 312/246
2,470,551 A * 5/1949 Fish ..... F25D 17/02 310/40 R
2,506,717 A * 5/1950 Fulmer ..... A47F 1/10 221/242
2,538,780 A * 1/1951 Hazard ..... F25D 23/02 62/378
2,572,508 A * 10/1951 Muffly ..... F25C 1/08 62/375
2,610,100 A * 9/1952 Childers ..... G07F 11/52 74/528
2,642,328 A * 6/1953 Nystedt ..... F25D 25/00 221/75
3,500,649 A * 3/1970 Feldman ..... F25D 25/00 62/3.6
4,006,606 A * 2/1977 Underdue ..... F25D 11/00 62/449
4,531,381 A * 7/1985 Toro ..... F25D 3/08 62/372
4,790,141 A * 12/1988 Glascock ..... F17C 3/02 62/51.1
4,920,763 A * 5/1990 Provest ..... F25D 17/02 62/378
5,159,818 A * 11/1992 Etou ..... F25B 5/04 222/138
5,191,773 A * 3/1993 Cassell ..... F25D 17/02 62/392
5,482,373 A * 1/1996 Hutchinson ..... G01K 11/14 374/E11.018
5,678,925 A * 10/1997 Garmaise ..... G01K 1/14 374/150
5,706,957 A * 1/1998 Hardy ..... A47F 1/12 211/59.2
5,839,287 A * 11/1998 Stormo ..... F25D 17/065 62/89
6,082,114 A * 7/2000 Leonoff ..... B60H 1/00592 62/457.4
6,158,227 A * 12/2000 Seeley ..... G01K 1/14 374/E1.018
6,363,739 B1 4/2002 Hodosh et al.
6,703,590 B1 * 3/2004 Holley, Jr. ..... A47J 36/2433 126/265
6,799,434 B1 * 10/2004 Hobbs, Jr. ..... F25D 29/00 62/530
6,915,657 B1 7/2005 Wood
7,905,370 B2 * 3/2011 Leonetti ..... A47F 1/082 221/242
7,913,925 B2 * 3/2011 Ashworth ..... G05D 23/1902 236/94
8,334,780 B1 * 12/2012 Mendoza, Jr. ..... A47J 41/0094 340/584
9,919,632 B2 * 3/2018 Oh ..... B60Q 3/225
10,495,378 B2 * 12/2019 Spivey ..... F25D 31/007
2002/0005043 A1 * 1/2002 Rudick ..... F25D 31/007 62/6
2003/0219061 A1 * 11/2003 Seeger ..... G01K 3/04 374/E7.042
2004/0025530 A1 * 2/2004 Perrins ..... A45C 11/20 62/464
2004/0140304 A1 * 7/2004 Leyendecker ..... A47J 36/2433 219/521
2004/0144103 A1 * 7/2004 Lee ..... F25D 31/007 62/62
2006/0026971 A1 * 2/2006 Sharpe ..... G01K 13/00 62/126
2006/0053805 A1 * 3/2006 Flinner ..... F25D 11/00 62/3.2
2006/0150661 A1 * 7/2006 Kim ..... F25D 23/04 62/407
2006/0248918 A1 11/2006 Robertson
2006/0263267 A1 * 11/2006 Witz ..... A61F 7/0085 422/400
2006/0291533 A1 * 12/2006 Faries, Jr. ..... A61J 1/1462 374/E11.018
2008/0067187 A1 * 3/2008 Rudick ..... A47F 1/06 221/123
2008/0225510 A1 * 9/2008 Rocha ..... F21V 33/0056 362/86
2008/0245081 A1 * 10/2008 Shin ..... F25D 23/12 700/275
2009/0044549 A1 * 2/2009 Sundhar ..... F25D 31/007 62/132
2010/0224639 A1 * 9/2010 Peng ..... A47G 19/2227 220/694
2010/0251755 A1 * 10/2010 Lauchnor ..... F25D 31/007 62/457.7
2010/0288791 A1 * 11/2010 Myyrylainen ..... B67D 1/06 222/113
2010/0293970 A1 * 11/2010 Mooijer ..... F25D 16/00 62/62
2011/0225981 A1 * 9/2011 Glaros ..... F25B 21/02 62/3.6
2012/0159968 A1 * 6/2012 Doucet ..... F25D 31/007 62/157
2012/0260684 A1 10/2012 Wimbert et al.

(56) References Cited

U.S. PATENT DOCUMENTS

| | | | | |
|---|---|---|---|---|
| 2014/0001142 | A1* | 1/2014 | Wu | A61J 9/02 215/11.2 |
| 2014/0305151 | A1 | 10/2014 | Nottingham et al. | |
| 2015/0122688 | A1* | 5/2015 | Dias | A47G 19/027 206/459.1 |
| 2015/0233631 | A1* | 8/2015 | Shuntich | F25D 3/08 62/64 |
| 2015/0323246 | A1* | 11/2015 | Spivey | F25D 31/007 62/443 |
| 2016/0209111 | A1 | 7/2016 | Jafa et al. | |
| 2016/0236605 | A1* | 8/2016 | Doi | F25D 31/007 |
| 2017/0045289 | A1* | 2/2017 | Watzke | F25D 31/005 |
| 2017/0176096 | A1* | 6/2017 | Lundberg | F25D 31/007 |
| 2018/0040795 | A1 | 2/2018 | Lam et al. | |

FOREIGN PATENT DOCUMENTS

| | | | | |
|---|---|---|---|---|
| WO | WO2009/150473 | A2 | 12/2009 | |
| WO | WO-2009150473 | A2 * | 12/2009 | F25D 16/00 |
| WO | WO2020/014242 | A1 | 1/2020 | |

OTHER PUBLICATIONS

International Search Report and Written Opinion of the International Searching Authority directed to related International Application No. PCT/US2019/041025, dated Sep. 23, 2019, 9 pages.
Extended European Search Report issued in European Application No. 19834066.3, dated Feb. 14, 2022, 8 pages.

* cited by examiner

BEVERAGE COOLER

CROSS-REFERENCE TO RELATED APPLICATION

This application claims priority to U.S. Provisional Application No. 62/697,276, filed Jul. 12, 2018, which is incorporated herein in its entirety by reference thereto.

FIELD

The described embodiments generally relate to beverage coolers. In particular, embodiments relate to rapid beverage coolers.

BACKGROUND

Some beverages are preferably served cold and, therefore, consumers may utilize a beverage cooler to chill and/or maintain the drink at a low temperature until it is ready to be consumed. Chilled beverages may be used by athletes in sports related applications to help regulate body temperature as well as hydration level. Beverage coolers come in many forms, and utilize a number of mechanisms for reducing the temperature of the beverage to be consumed. For example, some beverage coolers use ice as a means for chilling beverages. Some ice-based beverage coolers may require ice to be placed directly in contact with the beverage to be cooled. Other ice-based beverage coolers may require ice to be placed around a container in which the beverage is stored (e.g. a bottle or can). Others beverage coolers may use powered cooling systems, such as refrigeration systems or thermoelectric cooling, to cool the beverages.

BRIEF SUMMARY OF THE INVENTION

Some embodiments of the present invention provide beverage coolers for cooling bottle beverages. They may rapidly cooler bottle beverages using a refrigeration system, and may include a means for indicating to a user when the bottles have been chilled to a desirable temperature.

For example, embodiments include beverage coolers for cooling bottled beverages, where the beverage cooler includes a first chamber that a user may access via a cooler door, a second chamber beneath the first chamber, and a beverage container tray located between and separating the first chamber from the second chamber. The beverage container tray may include beverage container openings configured to receive a bottle to be chilled. A seal may be located within each beverage container opening in order to fill the space between the beverage container opening and a bottle placed in the beverage container opening. Each beverage container opening may include a visual indicator, where the visual indicator is configured to display information about the temperature of a bottle placed in the beverage container opening.

Embodiments also include beverage coolers for cooling bottled beverages, where the beverage cooler includes a cooling chamber having an opening, and a beverage container tray that is placed across and seals the opening of the cooling chamber. The beverage container tray may include beverage container openings configured to receive a bottle to be chilled. A door may be located within each beverage container opening, where the door is configured to open when a bottle is inserted into the beverage container opening. A seal may be located within each beverage container opening in order to fill the space between the beverage container opening and a bottle placed in the beverage container opening. Each beverage container opening may include a visual indicator, where the visual indicator is configured to display information about the temperature of a bottle placed in the beverage container opening.

Embodiments also include beverage coolers for cooling bottled beverages, where the beverage cooler includes a cooling chamber having an opening, and a cooler door that is placed across and seals the opening of the cooling chamber. A user may access the cooling chamber by opening the cooler door. The cooler may include beverage container receptacles configured to receive a bottle to be chilled. Each beverage container receptacle may include a visual indicator, where the visual indicator is configured to display information about the temperature of a bottle placed in the beverage container opening.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION OF THE INVENTION

Figure 1:
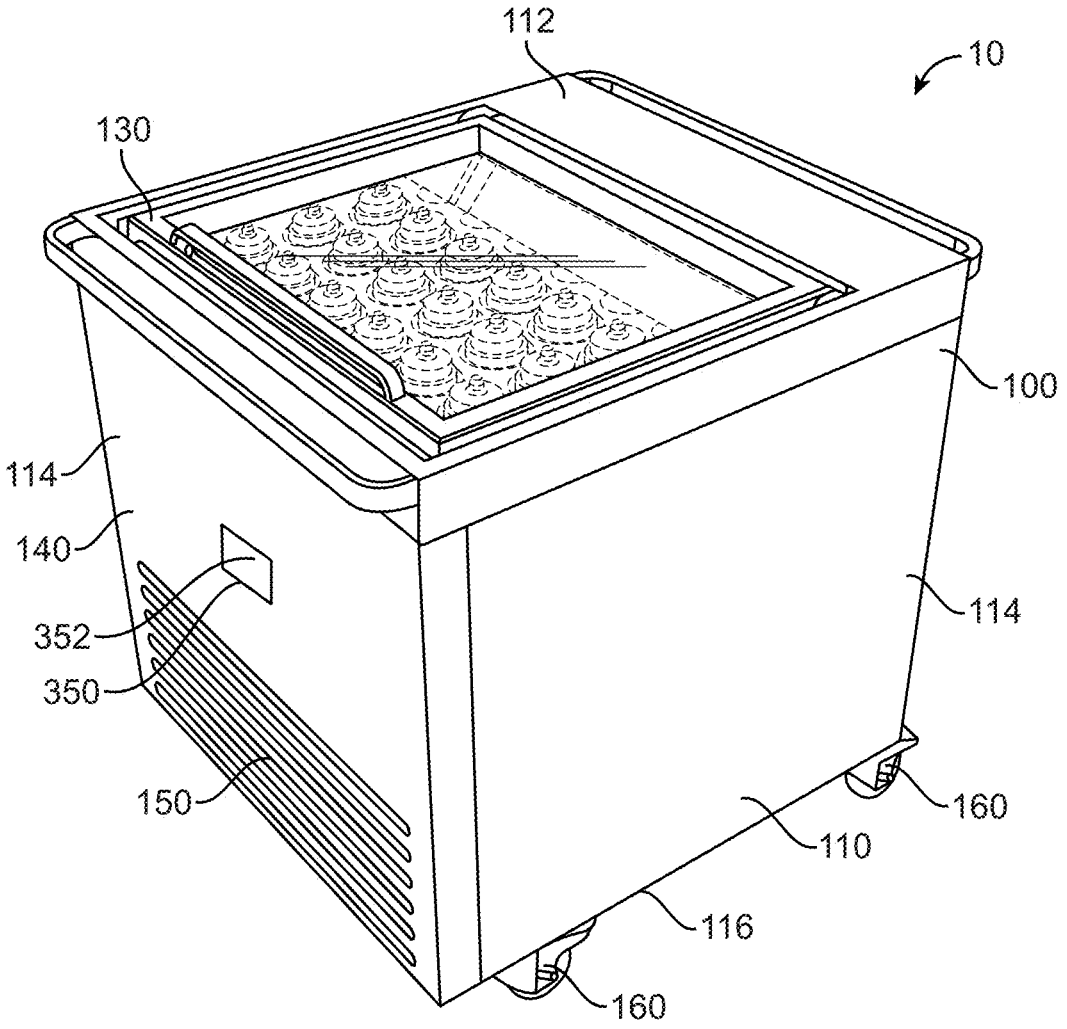
FIG. 1 is a perspective view of a beverage cooler according to some embodiments.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiments, it is submitted that it is within the knowledge of one skilled in the art to affect such feature, structure, or characteristic in connection with other embodiments whether or not explicitly described.

Some traditional beverage coolers utilize ice as the primary mechanism for chilling beverages that are to be consumed. These beverage coolers may include, for example, a thermally insulated housing filled with ice into which a liquid may be poured or a packaged beverage may be placed. However, the ice for these beverage coolers may be difficult to procure and replenish, in particular if the beverage cooler and ice maker are not at the same location.

Further, using ice as the primary cooling method may limit a user's control over the temperature of the beverage as well as the rate at which the beverage is cooled.

Some beverage coolers that use ice to cool beverages require the ice to be placed directly in contact with the liquid. Although this may chill the beverage, the concentration of the beverage will vary as the ice melts, thereby diluting the drink. This dilution may be less than desirable in drinks that have specific ratios of ingredients, such as sports drinks. If the beverage to be cooled is stored in a container, such as a bottle, some beverage coolers may require ice to be placed around the container. Although this method may not dilute the beverage, the ice may melt as it comes into contact with the relatively warm surface of the container, making the surface of the container wet. This may require a consumer to wipe off the bottle before drinking the beverage, which may adversely affect the consumer's experience.

Some beverage coolers do not use ice as the primary cooling mechanism, but rather use powered cooling systems, such as refrigeration systems or thermoelectric cooling systems. However, some existing powered beverage coolers may not cool beverages rapidly or efficiently enough to be useful in applications that demand a continuous high volume of chilled beverages, such as at sporting events. For example, some existing beverage coolers may not have the ability to cool beverages as quickly as they are warmed by ambient conditions after being removed from the beverage cooler. Similarly, some existing beverage coolers may not have the ability to cool the volume of beverages necessary to match or exceed their rate of consumption. This may be particularly true in sports related applications, where athletes may consume large quantities of drinks in a short amount of time.

In some powered beverage coolers, condensation may form on the exterior surface of the beverage container once it has been chilled, which may require a consumer to wipe off the bottle before drinking the beverage. As with the ice-based coolers, this may adversely affect a consumer's experience.

Some beverage coolers, powered or unpowered, may not display the temperature of the beverage being chilled, which may result in the beverage being removed and consumed at a warmer than desirable temperature. Similarly, the beverage may be left in the cooler longer than necessary after it has reached a desirable temperature, wasting energy or resources and occupying cooler space that could otherwise be utilized by another beverage.

As described herein, some embodiments may provide an efficient system for rapidly cooling beverages in bottles without the use of ice. Some of these beverage coolers may include a cooling chamber into which one or more bottles may be inserted to be chilled. The beverage cooler may include a refrigeration system with an evaporator and a fan in the cooling chamber, where the evaporator removes heat from the cooling chamber, and the fan circulates chilled air around the bottles and through the evaporator in the cooling chamber. The bottles to be chilled may be inserted into the cooling chamber through openings in the cooling chamber. Each opening may have a respective door that minimizes air loss when a bottle is not disposed in the opening, and may have a respective seal that minimizes air loss when a bottle is disposed in the opening. Each seal may wipe condensation off the exterior surface the bottle as the bottle is removed from the opening, such that a user may receive from the beverage cooler a relatively dry, chilled bottle. One or more openings, and in some embodiments, each opening, may have a respective display, such as, for example, a series of lights that use color or light intensity, for example, to indicate the temperature of the bottle disposed in the opening, or to indicate whether or not the bottle has been chilled to a desirable temperature. Some embodiments may allow a user to select a desired beverage temperature and/or a rate of cooling of the beverages using an automatic control system.

Figure 2:
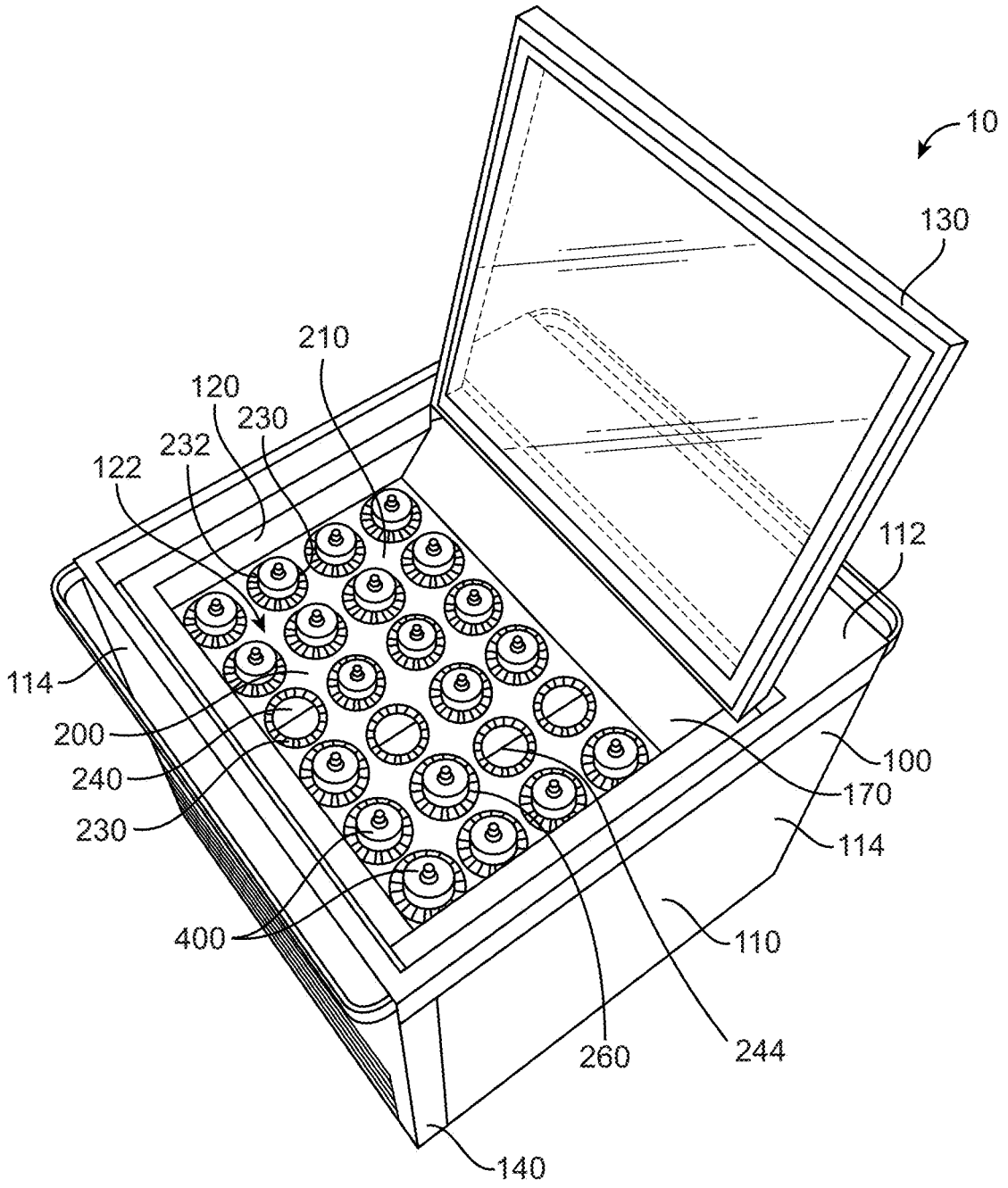
FIG. 2 is a perspective view of a beverage cooler of FIG. 1 in an open position according to some embodiments.
Figure 3:
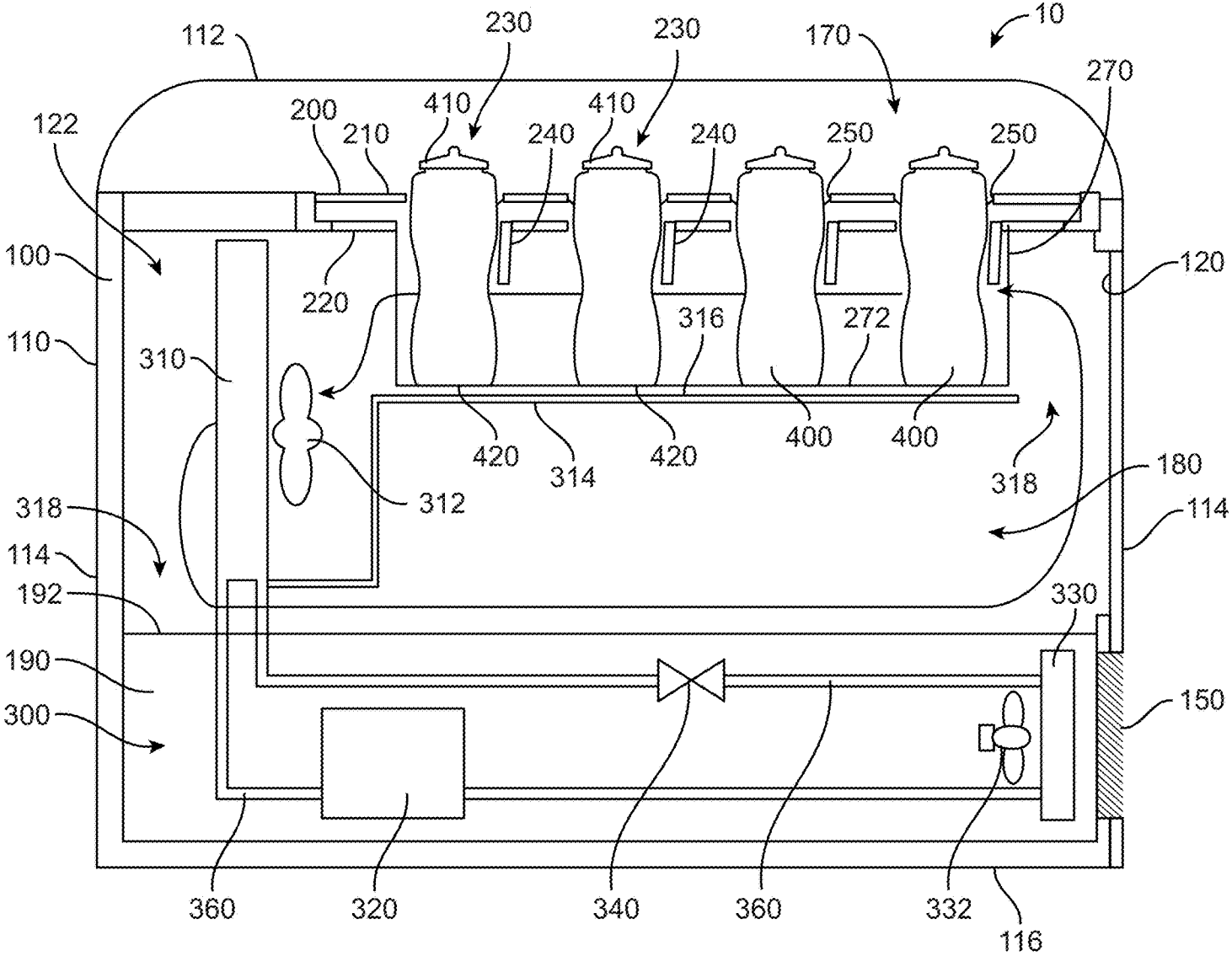
FIG. 3 is a partial sectional view of a beverage cooler according to some embodiments.

Embodiments will now be described in more detail with reference to the figures. With reference to FIGS. 1-3, a beverage cooler 10 may include a cooler housing 100, a beverage container tray 200, and a cooling system 300.

Cooler housing 100 may be configured to receive and store a plurality of beverage containers 400, such as bottles 400, and to lower and/or maintain the temperature of the beverage containers 400. Beverage containers 400 may comprise bottles, squeeze bottles, cans, and other beverage containers for providing beverages to a consumer. Throughout the disclosure, components may be referred to with reference to a bottle but it will be appreciated that other beverage containers may be used. In some embodiments, cooler housing 100 is configured to rapidly lower the temperature of one or more beverage containers 400 such that a continuous high demand for chilled beverages at a desired temperature may be fulfilled. Cooler housing 100 may include an exterior surface 110 defining the shape of beverage cooler 10, and an interior surface 120 defining an interior space 122. In some embodiments, cooler housing 100 comprises a rectangular cuboid shape. In some embodiments, cooler housing 100 may comprise other shapes, including, for example, cubical, tubular, cylindrical, spherical, or frustoconical, and may or may not be symmetrical about any axis.

In some embodiments, cooler housing 100 may be made of metal, plastic, or a composite material, and combinations thereof. In some embodiments, cooler housing 100, or a portion of cooler housing 100, may include a thermally insulating material to reduce the exchange of heat between interior space 122 and the ambient conditions surrounding beverage cooler 10. In some embodiments, a layer of air may be sealed between the exterior surface 110 and the interior surface 120 to act as a thermal insulator.

Cooler housing 100 may include wheels 160, such as casters, which allow beverage cooler 10 to be rolled. In some embodiments, beverage cooler 10 may include four wheels 160 disposed on a bottom 116 of cooler housing 100.

Beverage container tray 200 may be disposed within cooler housing 100. In some embodiments, beverage container tray 200 may be a substantially planar member, and may have a top surface 210 and a bottom surface 220. As shown in FIGS. 1 and 2, for example, beverage container tray 200 may be oriented such that it is substantially perpendicular to one or more sides 114 of cooler housing 100. However, beverage container tray 200 may be disposed at a non-perpendicular angle relative to sides 114. Beverage container tray 200 may be disposed such that it divides at least a portion of interior space 122 into two parts, thereby forming a first chamber 170 and a second chamber 180. In some embodiments, second chamber 180 is disposed beneath or adjacent to first chamber 170. In some embodiments, first chamber 170 and second chamber 180 may be equal in volume. In some embodiments, first chamber 170 may have a greater volume than second chamber 180. In some embodiments, second chamber 180 may have a greater volume than first chamber 170. Beverage container tray 200 may include a thermally insulating material to reduce the exchange of heat between first and second chambers 170, 180.

Beverage container tray 200 may include a plurality of beverage container openings 230, which extend through beverage container tray 200 from top surface 210 to bottom surface 220. Each beverage container opening 230 may be configured to receive one of the beverage containers 400, such as a squeeze bottle 400. In some embodiments, beverage container openings 230 may have a perimeter 232 that is circular in shape, and may have a diameter of at least 2 inches. As shown in FIG. 2, beverage container tray 200 may include twenty-four beverage container openings 230, which are arranged in a grid pattern defining rows and columns of openings 230. However, beverage container tray 200 may include any number of beverage container openings 230 in any arrangement.

Figure 5:
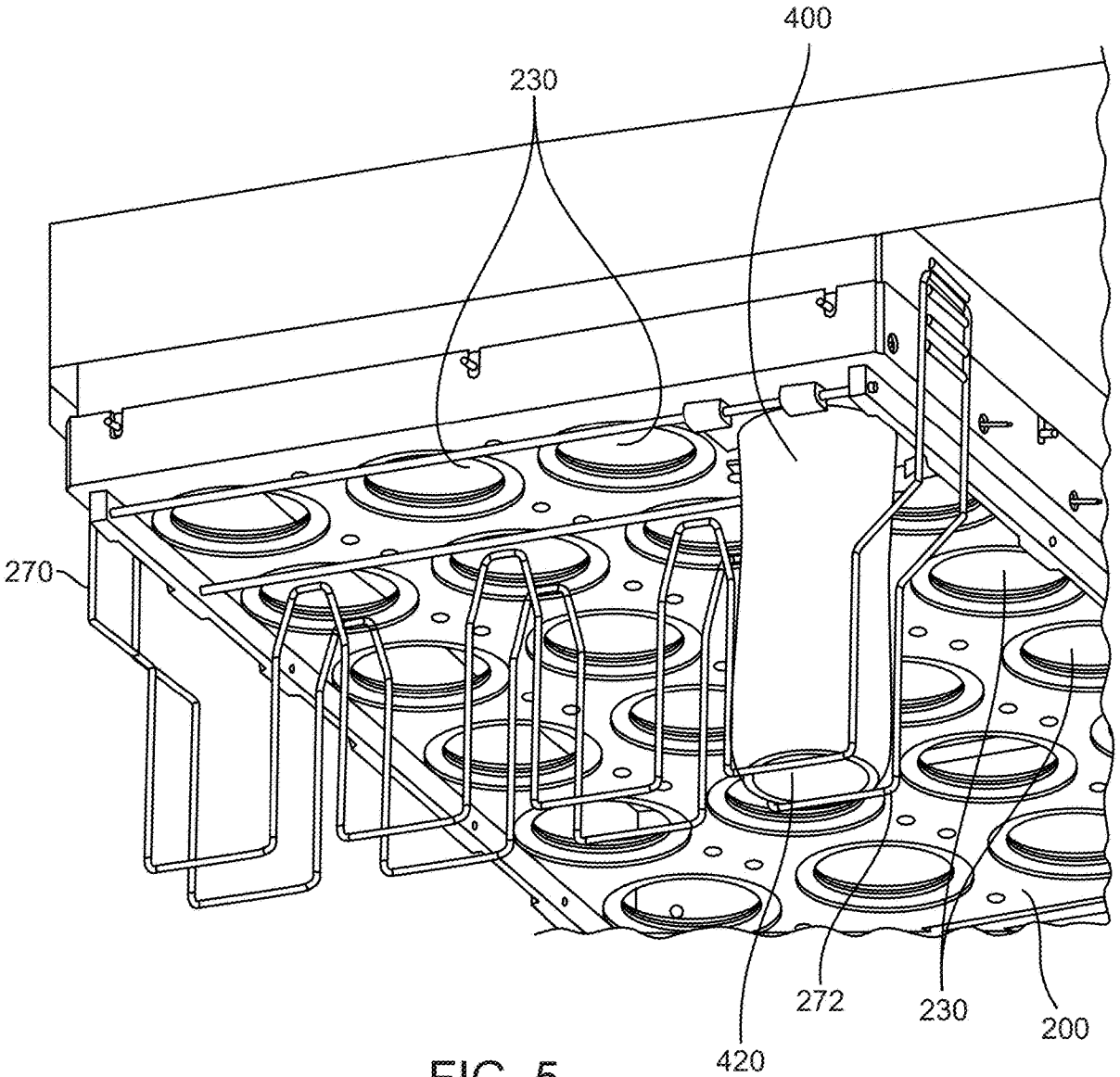
FIG. 5 is a partial perspective view of a beverage cooler according to some embodiments.

As shown in FIGS. 3 and 5, for example, a beverage container shelf 270 may be disposed within cooler housing 100, and may have a support surface 272 configured to support one or more beverage containers 400. In some embodiments, beverage container shelf 270 may be disposed beneath beverage container tray 200 in second chamber 180 such that a bottom end 420 of one or more beverage containers 400 disposed in beverage container openings 230 may be supported by support surface 272. In some embodiments, the distance between bottom surface 220 of beverage container tray 200 and support surface 272 may be less than the distance between a top end 410 and bottom end 420 of beverage container 400, such that the bottom end 420 of beverage container 400 may be disposed in second chamber 180, while the top end 410 of beverage container 400 may be disposed in first chamber 170. This arrangement may facilitate user access to the beverage container 400. In some embodiments, the distance between bottom surface 220 of beverage container tray 200 and support surface 272 may be at least half of the distance between top end 410 and bottom end 420 of beverage container 400.

In some embodiments, the position of beverage container shelf 270 may be adjustable relative to beverage container tray 200, such that beverage cooler 10 may cool beverage containers of various heights.

As shown in FIGS. 1 and 2, a first door 130 may be disposed in a top surface 112 of cooler housing 100 such that a user may access interior space 122 of cooler housing 100 through first door 130. In some embodiments, at least a portion of first door 130 may be made of a transparent material (e.g., glass or plastic), such that a user may see into interior space 122 of cooler housing 100 without opening first door 130. For example, first door 130 may include a transparent glass or plastic panel. In some embodiments, a user may access first chamber 170 though first door 130. With first door 130 in an open position, a user may insert a beverage container 400 to be chilled into one of beverage container openings 230, or may remove a chilled beverage container 400 from one of the beverage container openings 230.

Figure 4:
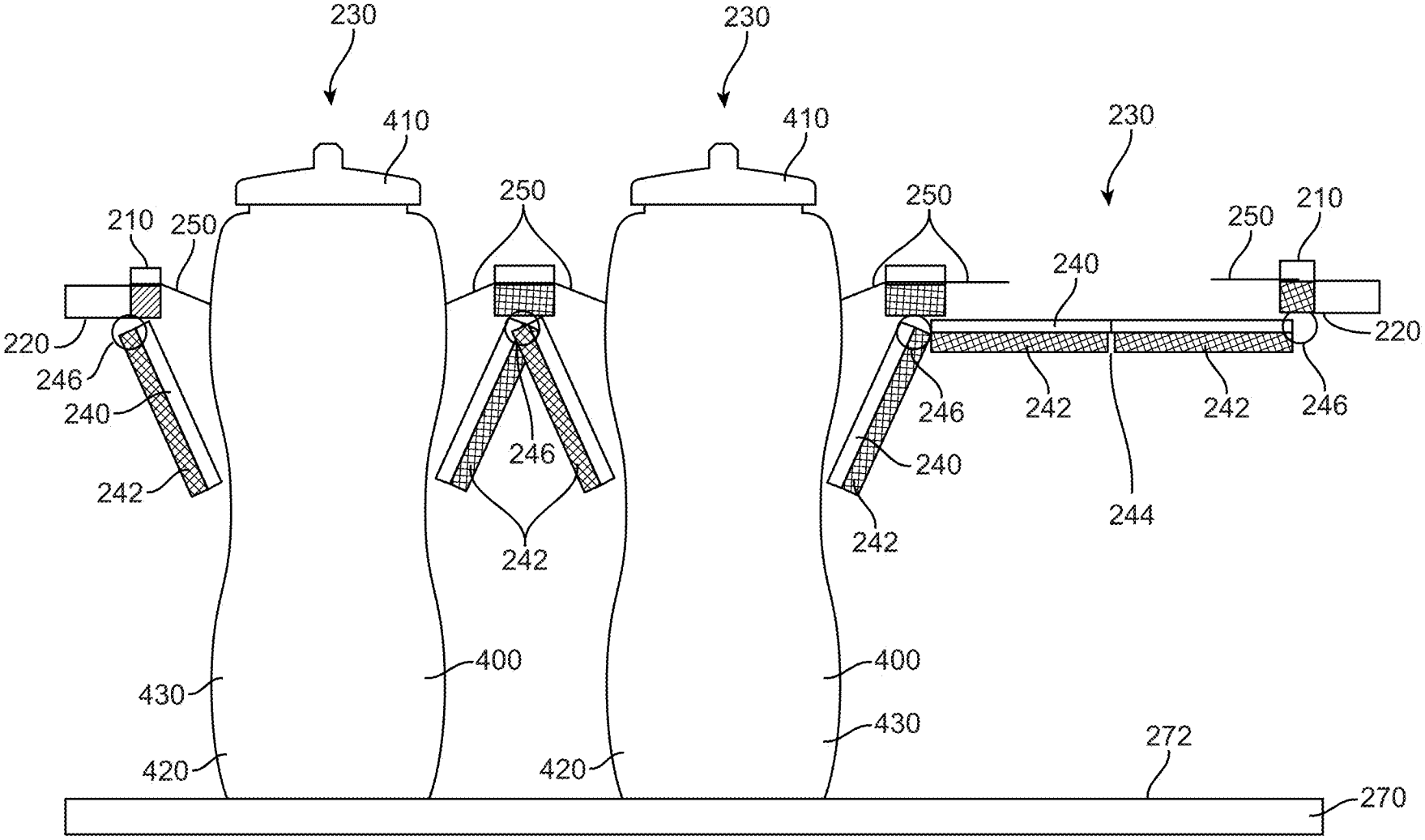
FIG. 4 is a partial sectional view of a beverage cooler according to some embodiments.

Beverage container tray 200 may include a plurality of beverage container doors 240 that are coupled to beverage container tray 200 and disposed at each of beverage container openings 230. As shown in FIG. 4, each beverage container door 240 may comprise two adjacent door flaps 242 hingedly connected to beverage container tray 200 and configured, together, to completely cover a respective beverage container opening 230. However, in some embodiments, each beverage container door 240 may comprise a single door flap 242 configured to completely cover a respective beverage container opening 230.

Beverage container doors 240 may be hingedly coupled to bottom surface 220 and may include one or more biasing mechanisms 246, which bias the doors in a closed position (i.e. covering a respective beverage container opening 230). When in a closed position, beverage container doors 240 may form a seal with beverage container tray 200, thereby restricting air from passing through the beverage container openings 230 when a beverage container 400 is not disposed in the beverage container opening 230. In an embodiment including two adjacent door flaps 242, a seam 244 may be formed where the two door flaps 242 meet in a closed position. Seam 244 may include a seal that restricts air from passing through seam 244. In some embodiments, one or more door flaps 242 may be substantially flat such that when the door flaps 242 are in a closed position when no beverage container is disposed in the corresponding beverage container opening 230, a substantially flat surface is provided. In one embodiment, biasing mechanisms 246 comprise torsional springs. Beverage container doors 240 may include a thermally insulating material to reduce the exchange of heat between first and second chambers 170, 180 when the beverage container doors 240 are in a closed position. Beverage container doors 240 may have an open position where beverage container doors 240 do not form a seal with beverage container tray 200 and do not cover a respective beverage container opening 230.

In some embodiments, when a user inserts a beverage container 400 into a beverage container opening 230, the bottom end 420 of the beverage container 400 may press against the respective beverage container door 240, overcoming the biasing force provided by biasing mechanism 246, and thereby causing beverage container door 240 to move from a closed position to an open position without direct contact from the user. Then, when a user removes a beverage container 400 from a beverage container opening 230, the biasing force provided by biasing mechanism 246 causes the beverage container door 240 to automatically move from an open position to a closed position. In some embodiments, beverage container door 240, including door flaps 242 may be made of plastic, hard rubber, or other suitable rigid or semi-rigid material.

In some embodiments, beverage container tray 200 may include a plurality of beverage container seals 250 that are coupled to beverage container tray 200 and disposed at one or more of beverage container openings 230. In some embodiments, when a beverage container 400 is disposed in a beverage container opening 230, seals 250 may be configured to fill the space between beverage container tray 200 and an exterior surface 430 of the beverage container 400, thereby preventing air from passing through the beverage container opening 230 when a beverage container 400 is disposed in the beverage container opening 230. In some embodiments, seals 250 may be made of silicon, rubber, or another flexible material.

In some situations, condensation may form on the exterior surface 430 of a beverage container 400 when the beverage container 400 is being chilled in beverage cooler 10. Beverage container seals 250 may be configured to remove condensation from the beverage container 400 when the beverage container 400 is being removed from beverage cooler 10. Beverage container seal 250 may be flush with the exterior surface 430 of the beverage container 400, and therefore, when the beverage container 400 is removed from beverage container opening 230, seal 250 will wipe along exterior surface 430 of the beverage container 400, thereby collecting and removing accumulated condensation from exterior surface 430.

Figure 6:
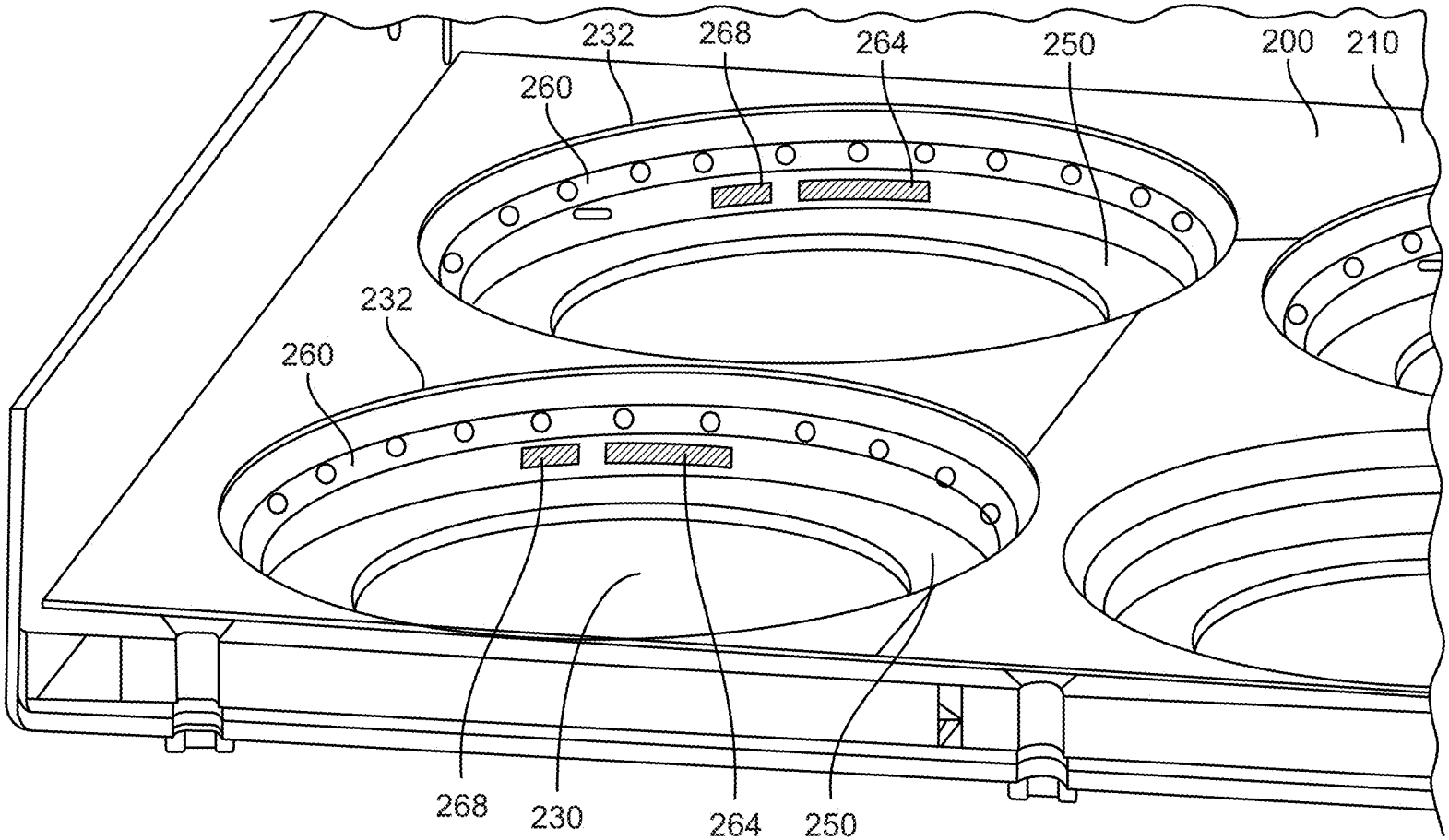
FIG. 6 is a partial perspective view of a beverage cooler according to some embodiments.

As shown in FIG. 6, beverage container tray 200 may include one or more visual indicators 260, which are configured to display information about beverage containers 400 disposed in beverage container tray 200. In some embodiments, there may be one visual indicator 260 for each beverage container opening 230, and each visual indicator 260 may be configured to display information relating to the temperature of a beverage container 400 disposed in the respective beverage container opening 230. In some embodiments, a visual indicator 260 may be associated with a row or column of beverage containers 400 to display information relating to the temperature of the beverage containers disposed in the respective row or column. In some embodiments, visual indicators 260 may be a plurality of lights (e.g., LEDs) disposed along perimeter 232 of each respective beverage container opening 230. In some embodiments, visual indicators 260 may be a single light, a multi-colored light, or an electronic display. In some embodiments, visual indicators 260 may be disposed within first chamber 170. In some embodiments, visual indicators 260 may be disposed outside of first chamber 170, and may be, for example, coupled to exterior surface 110.

Figure 7A:
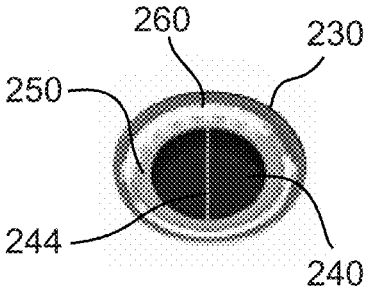
FIG. 7A is a partial perspective view of a beverage cooler according to some embodiments.
Figure 7B:
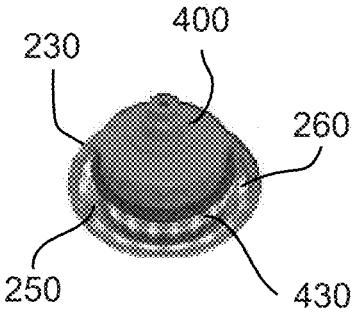
FIG. 7B is a partial perspective view of a beverage cooler and a beverage container according to some embodiments.

In embodiments where visual indicator 260 comprises a plurality of lights, visual indicator 260 may be disposed within beverage container opening 230. As shown in FIG. 7A, for example, if a beverage container 400 is not disposed within the beverage container opening 230, the lights may illuminate the beverage container opening 230, seal 250, and/or beverage container door 240. As shown in FIG. 7B, for example, if a beverage container 400 is disposed within the beverage container opening 230, the lights may illuminate the exterior surface 430 of beverage container 400, beverage container opening 230, and/or seal 250.

Visual indicators 260 may be electronically coupled to an indicator controller 262, which may control visual indicators 260 based on the temperature, or estimated temperature of the beverage containers 400 disposed in beverage container openings 230. In some embodiments, each beverage container opening 230 may include a temperature sensor 264 that measures the temperature of the exterior surface 430 of a beverage container 400 disposed in the beverage container opening 230. Indicator controller 262 may be electronically coupled to a temperature sensor 264 and may receive input from temperature sensor 264. In some embodiments, each beverage container opening 230 may include a beverage container sensor 268 that senses when a beverage container 400 is inserted into the beverage container opening 230. Indicator controller 262 may be electronically coupled to beverage container sensor 268 and may receive input from beverage container sensor 268. Indicator controller 262 may estimate the temperature of the beverage container 400 based on the amount of time that the beverage container 400 has been disposed in the beverage container opening 230, which may be measured from the time when beverage container sensor 268 first senses a beverage container 400.

In some embodiments, visual indicator 260 may be a plurality of multi-colored LEDs configured to display certain colors corresponding to the measured temperature or estimated temperature of a beverage container 400. For example, if the measured temperature or estimated temperature of a beverage container 400 is warmer than a desired temperature, red lights may be illuminated by indicator controller 262, suggesting that a particular beverage container is not ready for consumption. If the measured temperature or estimated temperature of a beverage container 400 is equal to or colder than the desired temperature, blue lights may be illuminated by indicator controller 262. Similarly, visual indicator 260 may be a plurality of single-colored LEDs configured to turn on or off based on the measured temperature or estimated temperature of a beverage container 400. For example, if the measured temperature or estimated temperature of a beverage container 400 is warmer than a desired temperature, no lights may be illuminated. If the measured temperature or estimated temperature of a beverage container 400 is equal to or colder than the desired temperature, the lights may be illuminated by indicator controller 262 to indicate that cooling is complete. In some embodiments, visual indicator 260 may be a plurality of LEDs configured to vary in light intensity based on the measured temperature or estimated temperature of a beverage container 400. For example, if the measured temperature or estimated temperature of a beverage container 400 is warmer than a desired temperature, the lights may be dimly illuminated. If the measured temperature or estimated temperature of a beverage container 400 is equal to or colder than the desired temperature, the lights may be brightly illuminated or may flash on and off to indicate that cooling is complete. In some embodiments, the desired temperature may be user-defined.

As shown in FIG. 3, beverage cooler 10 may include a cooling system 300, which may be, for example, a refrigeration system having an evaporator 310, a compressor 320, a condenser 330, and an expansion valve 340, interconnected with pipes 360 and containing a refrigerant.

Evaporator 310 may be disposed in second chamber 180, and may comprise a coil used to absorb heat from the air in second chamber 180. In some embodiments, a circulation fan 312 may be disposed in second chamber 180 to circulate air within second chamber 180, such that air is drawn over evaporator 310, cooled, and then moved to cool the beverage containers 400 disposed in second chamber 180.

In some embodiments, a circulation divider 314 may be disposed in second chamber 180. In some embodiments, second chamber 180 may have a generally rectangular cuboid shape. Circulation divider 314 may extend between two opposing sides 114 of cooler housing 100, while leaving circulation spaces 318 between circulation divider 314 and interior surface 120 on the two remaining sides 114. In this configuration, air displaced by circulation fan 312 may travel in a loop within second chamber 180. As shown in FIG. 3, air may be drawn by circulation fan 312 through evaporator 310. Then, the air may reach a side 114, where it is forced downward through circulation space 318 and beneath circulation divider 314. Then, when the air reaches an opposing side 114, it may be forced upward through the opposing circulation space 318, where it travels above circulation divider 314, through beverage containers 400, and back to fan 312 completing the loop. This configuration may allow a greater volume of air to come into contact with evaporator 310, which may help rapidly cool beverage containers 400. In some embodiments, beverage cooler may cool beverage containers 400 more quickly than they are warmed by the ambient conditions.

In some embodiments, beverage container doors 240 may be oriented parallel to the direction of airflow in the second chamber 180 when in an open position, such that air may more easily flow past doors 240 when opened.

In some embodiments, circulation divider 314 may also be used to support beverage containers 400 in a manner similar to beverage container shelf 270, where the bottom end 420 of a beverage container 400 may rest upon a top surface 316 of circulation divider 314. In some embodiments, circulation divider 314 may be made of metal, and may be conductively coupled to evaporator 310. In embodiments where beverage containers 400 rest upon top surface 316 of circulation divider 314, beverage containers 400 may be cooled by conduction.

In some embodiments, interior space 122 may include a floor 192, which may be disposed to divide interior space 122, forming a mechanical chamber 190 adjacent to one or both of the first and second chambers 170, 180. The floor may include a thermally insulating material to reduce the exchange of heat between first and/or second chambers 170, 180 and the mechanical chamber 190.

Compressor 320 may be disposed in the mechanical chamber 190, along with the condenser 330, a condenser fan 332, and expansion valve 340. In some embodiments compressor 320 may be electrically powered and may use grid power. In some embodiments, compressor 320 may be electrically powered and receive power from batteries, which may be stored in mechanical chamber 190. In some embodiments, compressor 320 may be powered by gasoline or another petroleum based fuel.

Condenser 330 may be disposed in mechanical chamber 190 and may comprise a coil used expel to the environment heat absorbed by evaporator 310. In some embodiments, a vent 150 may be disposed in a side 114 of cooler housing 100, whereby heat from condenser 330 may pass from mechanical chamber 190 to the ambient surroundings. In some embodiments, condenser 330 may be disposed outside of cooler housing 100, and may be, for example, attached to a side 114 of cooler housing 100. In some embodiments, a condenser fan 332 may be disposed proximal to condenser 330, and may force air through the condenser 330 such that heat is more rapidly dissipated from the condenser 330. In some embodiments, the condenser fan 332 may be disposed in the mechanical chamber 190. In some embodiments, the condenser fan 332 may be disposed adjacent to vent 150. In some embodiments, no condenser fan 332 may be used, and air may naturally pass over condenser 330 in order to dissipate heat from condenser 330. Expansion valve 340 may be disposed in mechanical chamber 190 and may regulate the amount of refrigerant flowing through pipes 360 into evaporator 310.

As shown in FIG. 1, in some embodiments, cooling system 300 may also include a cooling controller 350 that may be used to automatically control the cooling system 300. The cooling controller 350, may include a user interface 352 whereby a user may turn cooling system 300 on or off, set a desired temperature of one or both of chambers 170, 180, or set a rate at which to cool the beverage containers 400. User interface 352 may include a means for receiving user input (e.g., electromechanical buttons), a means for communicating with a user (e.g., a visual display), and/or a combined means for receiving input and communicating with a user (e.g., a touch screen display). User interface 352 may include a combination of buttons, visual displays, and/or touch screens. User interface may be disposed in side 114 of cooler housing 100. In some embodiments, user interface may be remotely connected to cooling system 300, such that user interface is not fixed to beverage cooler 10. User interface 352 may be interconnected to cooling system 300 by a wired or wireless connection. In some embodiments, a user may control cooling system 300 using an application on a mobile communications device (e.g., a smartphone).

In some embodiments, cooling controller 350 may be used to automatically vary the rate at which cooling system 300 cools one or both of chambers 170, 180 and/or beverage containers 400. When cooling system 300 is first initiated, for example, cooling system 300 may operate to rapidly cool one or both of chambers 170, 180 and/or beverage containers 400 from an ambient temperature to a chilled temperature within a given amount of time. For example, during this initial stage of cooling, cooling system 300 may reduce the temperature of beverage containers 400 from approximately 70-110 degrees Fahrenheit to less than approximately 30-50 degrees Fahrenheit in less than approximately 30-90 minutes. In some embodiments, cooling system 300 may reduce the temperature of beverage containers 400 from approximately 90 degrees Fahrenheit to less than approximately 40 degrees Fahrenheit in less than approximately 60 minutes. Cooling system 300 may produce chilled air within one or both of cooling chambers 170, 180 that is approximately −20-20 degrees Fahrenheit. In some embodiments, cooling system 300 may produce chilled air within one or both of cooling chambers 170, 180 that is approximately −5 degrees Fahrenheit. Then, after the initial stage of cooling is complete, cooling system 300 may automatically decrease the rate at which one or both of chambers 170, 180 and/or beverage containers 400 are cooled, or may maintain a particular temperature of one or both of the chambers 170, 180 and/or beverage containers 400. Cooling controller 350 may receive input from one or more temperature sensors 264, and may vary the rate of cooling, the stage of cooling, or may turn on or off cooling system 300 based on the input received from temperature sensor 264. In some embodiments, cooling system 300 may maintain the temperature of beverage containers 400 at a user-defined temperature. In some embodiments, cooling system 300 may maintain the temperature of beverage containers 400 at approximately 20-40 degrees Fahrenheit. In some embodiments, cooling system 300 may maintain the temperature of beverage containers 400 at approximately 32 degrees Fahrenheit.

In some embodiments, a second door 140 may be disposed on a side 114 of cooler housing 100, whereby a user may access interior space 122 of cooler housing 100 through second door 140. In some embodiments, a user may access only mechanical chamber 190 using second door 140. In some embodiments, a user may access one or more of first, second, or mechanical chambers 170, 180, 190 using second door 140.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A beverage cooler, comprising:

a first chamber accessible to a user through a cooler door;

a second chamber disposed beneath and separated from the first chamber;

a beverage container tray disposed between and separating the first chamber from the second chamber, wherein the beverage container tray comprises a plurality of tray openings, each tray opening configured to receive a beverage container;

a seal disposed within each tray opening, wherein the seal is configured to fill a space between each tray opening and the beverage container disposed in the respective tray opening; and a visual indicator at a tray opening of the plurality of tray openings, the visual indicator electronically coupled to an indicator controller configured to control the visual indicator based on a temperature of the beverage container disposed in the respective tray opening, wherein the indicator controller is electronically coupled to a temperature sensor, and wherein the visual indicator is configured to display information about the temperature of the beverage container disposed in the respective tray opening.

2. The beverage cooler of claim 1, further comprising a refrigeration system disposed in the second chamber.

3. The beverage cooler of claim 2, wherein the refrigeration system comprises an evaporator coil and a fan disposed in the second chamber.

4. The beverage cooler of claim 1, wherein a beverage container door is disposed at each tray opening, wherein the beverage container door is configured to open when a beverage container is inserted into the tray opening.

5. The beverage cooler of claim 1, wherein the visual indicator comprises a plurality of LED lights disposed along a perimeter of the tray opening.

6. The beverage cooler of claim 1, further comprising a beverage container shelf disposed in the second chamber, wherein the beverage container shelf is configured to support one or more beverage containers disposed in the tray openings.

7. The beverage cooler of claim 6, wherein the beverage container shelf is positioned such that at least a portion of a beverage container being supported by the beverage container shelf is disposed within the first chamber.

8. The beverage cooler of claim 6, wherein the position of the beverage container shelf is adjustable.

9. The beverage cooler of claim 1, wherein at least a portion of the cooler door is transparent such that a user may see into the first chamber.

10. A beverage cooler, comprising:

a cooling chamber having an opening;

a beverage container tray disposed across the opening of the cooling chamber, wherein the beverage container tray comprises a plurality of beverage container openings each configured to receive a beverage container;

a door disposed at each beverage container opening and configured to open when a beverage container is inserted into the respective beverage container opening;

a seal disposed within each beverage container opening, wherein the seal is configured to fill a space between the beverage container opening and a beverage container disposed in the respective beverage container opening; and a visual indicator at a beverage container opening, wherein the visual indicator is configured to display information about a temperature of a beverage container disposed in the respective beverage container opening.

11. The beverage cooler of claim 10, further comprising a refrigeration system.

12. The beverage cooler of claim 11, wherein the refrigeration system comprises an evaporator coil and a fan disposed within the cooling chamber.

13. The beverage cooler of claim 10, wherein the visual indicator comprises a plurality of LED lights disposed along a perimeter of the beverage container opening.

14. The beverage cooler of claim 10, wherein the beverage container disposed in one of the plurality of beverage container openings is accessible by a user to receive a chilled beverage container.

15. The beverage cooler of claim 10, wherein the doors are biased to be closed when a beverage container is not in the respective beverage container opening.

16. The beverage cooler of claim 10, wherein the doors comprise two adjacent door flaps, wherein a sealed seam is formed between the two door flaps when the door flaps are in a closed position.

17. A beverage cooler, comprising:

a cooling chamber having an opening;

a cooler door disposed across the opening of the cooling chamber, wherein the cooler door may be opened by a user to access the cooling chamber;

a plurality of beverage container openings disposed within the cooling chamber, wherein each beverage container opening is configured to receive a beverage container; and a visual indicator at each beverage container opening, wherein the visual indicator is configured to display information about a temperature of a beverage container disposed in the respective beverage container opening.

18. The beverage cooler of claim 17, wherein the visual indicator is a plurality of LED lights that vary in color according to the temperature of the beverage container.

19. The beverage cooler of claim 17, wherein the visual indicators are disposed along perimeters of the beverage container openings.

20. The beverage cooler of claim 17, wherein the visual indicators are disposed within the beverage container openings.

21. The beverage cooler of claim 20, wherein at least a portion of the cooler door is transparent such that the user may see into the cooling chamber.

* * * * *